US005298277A

United States Patent [19]

Hirose

[11] Patent Number: 5,298,277

[45] Date of Patent: Mar. 29, 1994

[54] METHOD FOR DECREASING SPRAY COATING NONUNIFORMITY AT AN END PORTION OF A MOVING WORKPIECE

[75] Inventor: Akio Hirose, Kobe, Japan

[73] Assignee: Kabushiki Kaisha Kobe Seiko Sho, Kobe, Japan

[21] Appl. No.: 926,176

[22] Filed: Aug. 7, 1992

[30] Foreign Application Priority Data

Aug. 9, 1991 [JP] Japan ..... 3-200437

[51] Int. Cl.[5] ..... B05D 1/02

[52] U.S. Cl. ..... 427/8; 427/424; 427/480; 118/323; 118/624; 118/631; 118/679; 118/712

[58] Field of Search ..... 427/8, 421, 424, 477, 427/479, 480; 118/323, 624, 625, 631, 668, 676, 679, 683, 684, 712

[56] References Cited

U.S. PATENT DOCUMENTS

| | | | |
|---|---|---|---|
| 2,559,225 | 7/1951 | Ransburg . | |
| 2,636,471 | 4/1953 | Starkey | 118/624 |
| 3,593,308 | 7/1971 | Fagan . | |
| 3,777,702 | 12/1973 | Fitzgerald | 118/668 |
| 4,357,900 | 11/1982 | Buschor | 118/684 |

FOREIGN PATENT DOCUMENTS

| | | | |
|---|---|---|---|
| 698615 | 11/1964 | Canada | 118/679 |
| 3014500 | 10/1981 | Fed. Rep. of Germany | 118/679 |
| 491929 | 3/1976 | U.S.S.R. | 118/682 |
| 638386 | 12/1978 | U.S.S.R. | 118/668 |
| 2077007 | 12/1981 | United Kingdom . | |

OTHER PUBLICATIONS

Patent Abstracts of Japan, JP-A-21 84 363, Jul. 18, 1990, Hirose Akio, "Coating Device".

*Primary Examiner*—Terry J. Owens

*Attorney, Agent, or Firm*—Oblon, Spivak, McClelland, Maier & Neustadt

[57] ABSTRACT

A coating method which reduces the nonuniformity of a sprayed coating film at an end portion of a moving workpiece. A spray gun moves along a locus in a direction transverse to a conveying direction of the workpiece. The dimensions of the workpiece and passage of an end portion of the workpiece past the spray gun are detected. A reduced amount of coating material is sprayed at an end portion of the workpiece in response to the determination of passage of the end portion past the spray gun in order to prevent an increase in thickness of the coating film at the end portion. In the case of electrostatic spraying, an increase in film thickness at the end portion can be prevented by reducing or nullifying the electrostatic voltage applied to the end portion of the workpiece.

3 Claims, 3 Drawing Sheets

METHOD FOR DECREASING SPRAY COATING NONUNIFORMITY AT AN END PORTION OF A MOVING WORKPIECE

BACKGROUND OF THE INVENTION

The present invention relates to a method of coating a workpiece by spraying a coating material on the workpiece from a spray gun mounted on a coating device such as a robot or a reciprocator while moving the spray gun along a predetermined locus.

In a coating system as shown in FIG. 4 by way of example, a coating device (not shown) provided with a spray gun is located in opposition to a lateral side of a conveyor 20 for conveying a plurality of workpieces 21 and 22 in a direction depicted by an arrow shown in FIG. 4. The spray gun is reciprocatively moved substantially perpendicular to the moving direction of the conveyor 20, and is controlled to become on and off with a suitable timing, thereby carrying out electrostatic coating of the workpieces 21 and 22. A locus of relative movement of the spray gun with respect to the workpieces 21 and 22 is shown by a broken line in FIG. 4.

In the coating system as mentioned above, when the spray gun is merely on/off controlled in accordance with a shape of each of the workpieces 21 and 22, a coating film becomes thick at an end portion of each of the workpieces 21 and 22 by the influence of static electricity, or a coating film becomes thin at an upper end portion and thick at a lower end portion of each of the workpieces 21 and 22 by the action of air flowing from an upper area to a lower area in a spray booth.

To solve this problem, an on-region of the spray gun with respect to each of the workpieces 21 and 22 is that surrounded by a two-dot chain line shown in FIG. 4.

However, in the conventional coating system as mentioned above, the on-region of the spray gun with respect to the lateral edge of each workpiece slightly shifts due to the; relative movement of the spray gun with respect to the workpiece as shown in FIGS. 5A and 5B, so that the spray gun becomes on or off according to a pass thereof.

Accordingly, when the spray gun becomes off, a coating film becomes thin at a side end portion of the workpiece, while when the spray gun becomes on, the coating film becomes thick at the side end portion of the workpiece.

As a result, the coating film becomes nonuniform in thickness to reduce a coating quality.

SUMMARY OF THE INVENTION

It is accordingly an object of the present invention to provide a coating method which can reduce the nonuniformity of a coating film at an end portion of a workpiece to thereby improve a coating quality.

According to one aspect of the present invention, there is provided a method of coating a workpiece by spraying a coating material from a spray gun adapted to be moved along a predetermined locus, wherein a spray amount of the coating material from said spray gun is reduced in coating an end portion of a coating surface of said workpiece.

According another aspect of the present invention, there is provided a method of electrostatically coating a workpiece by spraying a coating material from a spray gun adapted to be moved along a predetermined locus, wherein an application degree of an electrostatic voltage is reduced or nullified in coating an end portion of a coating surface of said workpiece.

With this constitution of the coating method according to the present invention, the nonuniformity of a coating film at an end portion of a workpiece can be reduced to thereby improve a coating quality.

Other objects and features of the invention will be more fully understood from the following detailed description and appended claims when taken with the accompanying drawings.

DETAILED DESCRIPTION OF THE PREFERRED EMBODIMENT

There will now be described a preferred embodiment of the present invention with reference to the accompanying drawings. It is to be noted that the following preferred embodiment is merely illustrative and the technical scope of the present invention is not limited to the preferred embodiment.

Figure 1:
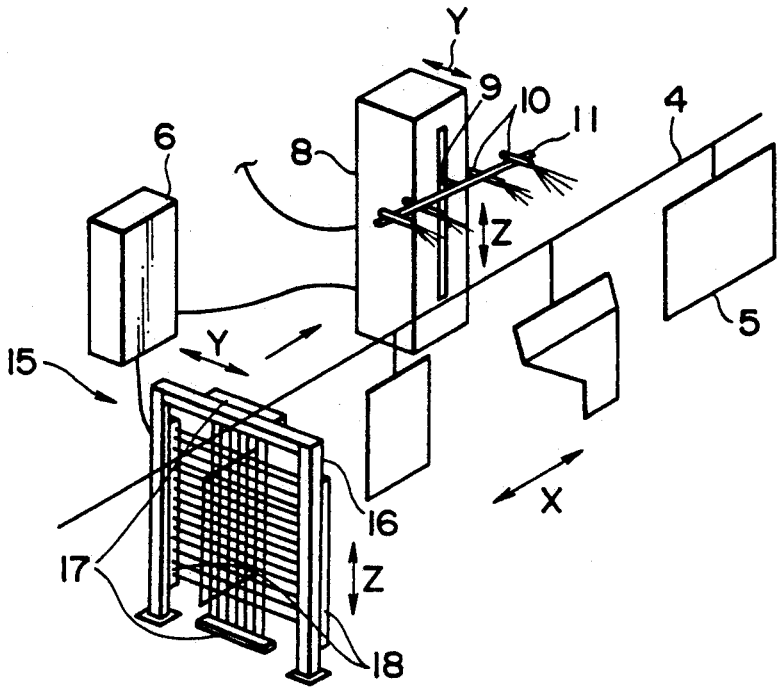
FIG. 1 is a perspective view of an essential part of a coating system to which a coating method according to a preferred embodiment of the present invention is applicable.

Referring to FIG. 1 which shows a coating system to which a coating method according to the preferred embodiment is applicable, reference numeral 8 designates a coating device provided with a support 9 adapted to be moved in a vertical direction (a longitudinal direction of the coating device 8, that is, in the Z direction shown in FIG. 1). The support 9 is provided with an arm 11 adapted to be moved in the Y direction shown in FIG. 1. The arm 11 is provided with a plurality (e.g., four) of spray guns 10 which are individually controllable to spray a coating material.

The coating device 8 is located in opposition to a lateral side of a conveyor 4, and is controlled by a control device 6 including a CPU, memories, interfaces, etc.

A shape detecting device 15 is located on the upstream side of the coating device 8 in respect of a moving direction of the conveyor 4. The shape detecting device 15 is constructed of a portal frame 16 disposed so as to straddle the conveyor 4, and a pair of photoelectric units 17 and 18 mounted on the portal frame 16 so as to be oriented in orthogonal relationship to each other. Each of the photoelectric units 17 and 18 is composed of a plurality of light emitting elements arranged in juxtaposition and a plurality of light receiving elements arranged in juxtaposition so as to be respectively opposed to the light emitting elements. The photoelectric unit 17 serves to detect a shape of a workpiece 5 in respect of the Y direction, and the photoelectric unit 18 serves to detect a shape of the workpiece 5 in respect of the Z direction.

In this coating system, an amount of movement of the conveyor 4 is detected by a conveyor pulse unit (not shown), and it is input into the control device 6. Dimensions of the workpiece 5 in respect of both the Y direction and the Z direction are detected per unit amount of movement of the conveyor 4, and they are input into the control device 6.

The detection data of the workpiece 5 in respect of the Y direction and the Z direction are stored into the control device 6. At the same time when the workpiece 5 is conveyed by the conveyor 4 to reach a position opposed to the spray guns 10 of the coating device 8, the spray guns 10 are moved and driven according to the detection data to carry out electrostatic coating of the workpiece 5.

In this system, the spray guns 10 are controlled basically so that they become on to spray the coating material only when the workpiece 5 passes a position opposed to the spray guns 10 and they become off not to spray the coating material when the workpiece 5 passes a position not opposed to the spray guns 10. According to the present invention, in order to reduce the nonuniformity of a coating film at an end portion of a coating surface of the workpiece 5 as far as possible and thereby improve the coating quality, the following correction control is carried out to the above-mentioned basic control pattern.

Figure 2:
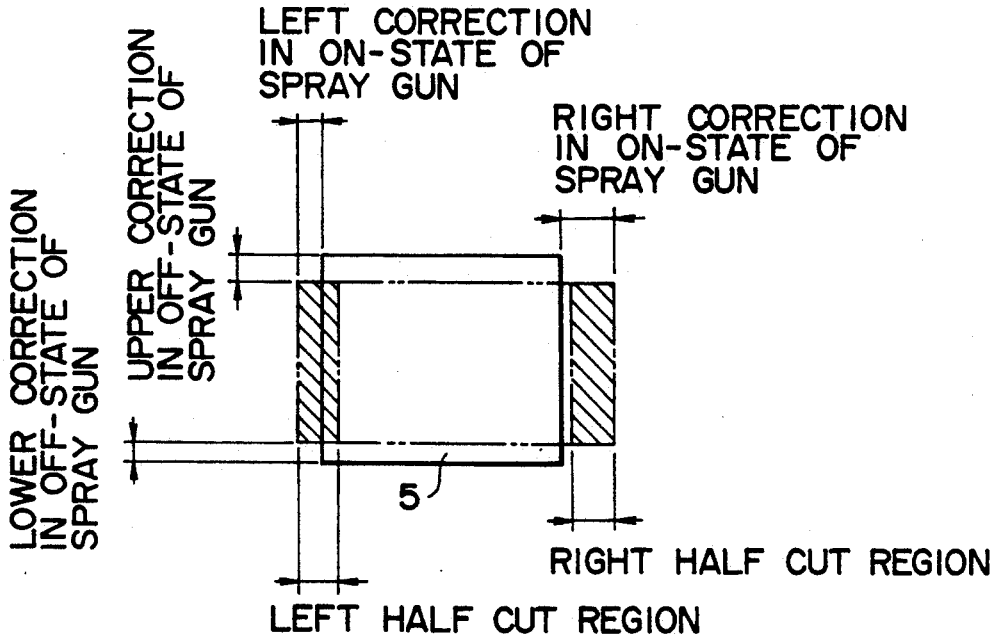
FIG. 2 is a schematic illustration of a coating pattern with respect to a workpiece in the coating system shown in FIG. 1.

As shown in FIG. 2, the correction control is carried out so that the spray guns 10 become off for an upper end portion and a lower end portion of the workpiece 5, while the spray guns 10 become on for a right end portion and a left end portion of the workpiece 5 with a spray amount of the coating material from the spray guns 10 reduced, in consideration of the case that an on-region of the spray guns 10 with respect to the workpiece 5 slightly shifts in relation to a locus of relative movement of the spray guns 10 with respect to the workpiece 5. Such a control region where the spray amount of the coating material from the spray guns 10 is reduced will be hereinafter referred to as a half cut region.

Figure 3:
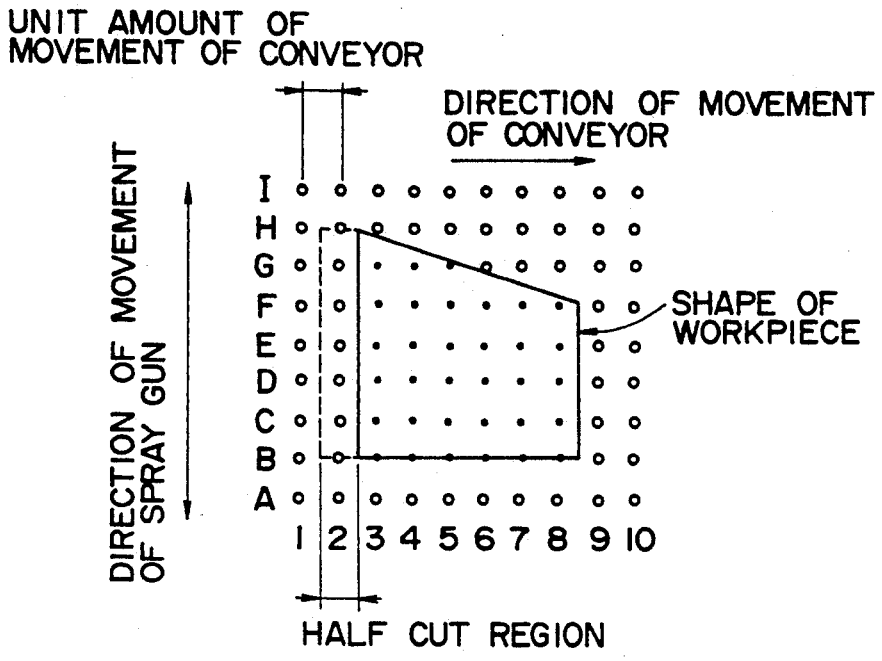
FIG. 3 is a schematic illustration of a control pattern of a spray gun as viewed from a relation between a shape detecting device and a shape of a workpiece in the coating system shown in FIG. 1.
Figure 4:
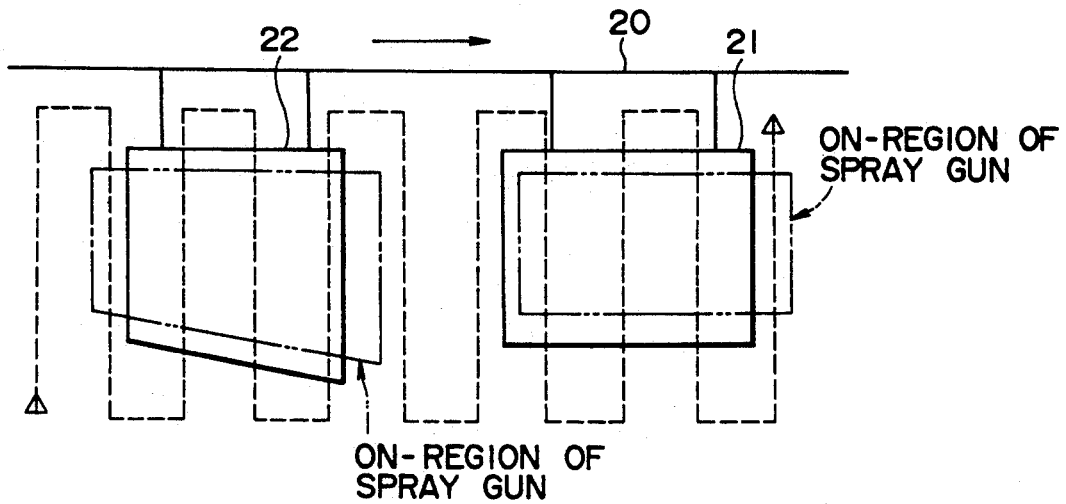
FIG. 4 PRIOR ART
FIG. 4 is an elevational view of an essential part in a conventional coating system.
Figure 5A:
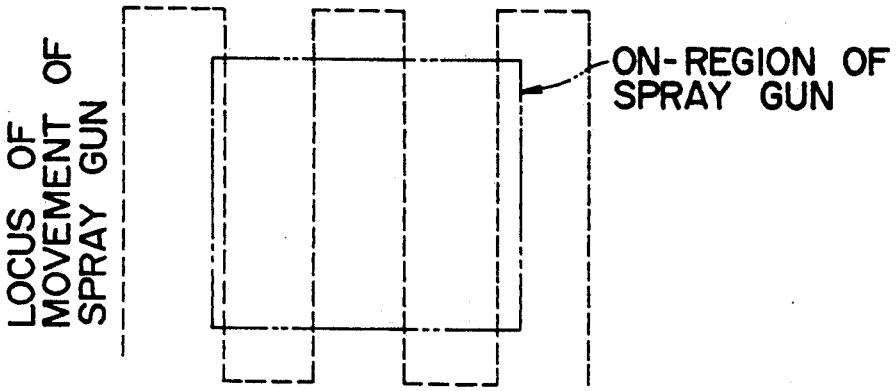
FIG. 5(A) PRIOR ART
FIGS. 5A and 5B are schematic illustrations explaining a relation between a locus of movement of a spray gun and an on-region of the spray gun in the conventional coating system.
Figure 5B:
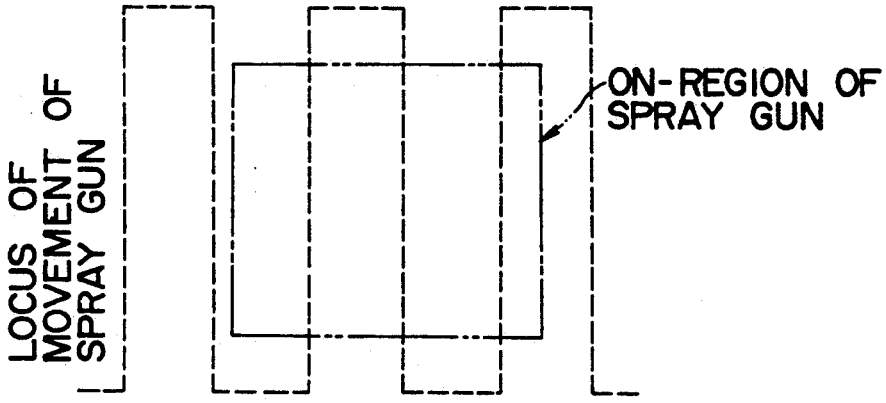
FIG. 5(B) PRIOR ART

In the case that the workpiece 5 has a shape as shown in FIG. 3, for example, the shape of the workpiece 5 is detected in accordance with an on-signal pattern output from the photoelectric unit 18, the on-signal pattern being formed by an aggregation of plural dots ● in FIG. 3, and the half cut region is set according to an off-signal pattern output from the photoelectric unit 18, in relation to the on-signal pattern.

For instance, when the spray guns 10 are relatively moved on a locus corresponding to the third pass in respect of a line direction, the spray guns 10 are controlled to become on between columns B and G in FIG. 3. Subsequently, the spray guns 10 are moved on a locus corresponding to the second pass in respect of the line direction to continue the on-state between the columns B and G, thus spraying the coating material with a spray amount reduced.

Accordingly, the nonuniformity of the coating film at the end portion of the coating surface of the workpiece can be reduced by the above-mentioned control to improve a coating quality.

Further, in the above system, the half cut region may be set also at the upper and lower end portions of the workpiece in addition to the right and left end portions of the workpiece.

Further, instead of the provision of the half cut region for the control of a spray amount of the coating material, an application degree of an electrostatic voltage in the electrostatic coating to a portion corresponding to the half cut region may be reduced or nullified to thereby make the coating film uniform at the end portion of the coating surface of the workpiece.

It is easily understood that the coating method as mentioned above is applicable to not only the reciprocating type coating device as mentioned above in the above preferred embodiment, but also a coating robot with spray guns having a multiple degree of freedom. Further, the coating method by providing the half cut region is effective not only in the electrostatic coating but also in any other ordinary coating works.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A method of coating a workpiece carried on a conveyor, comprising the steps of:

conveying the workpiece in a conveying direction;

moving a spray gun along a locus in a direction transverse to the conveying direction;

detecting the dimensions of the workpiece;

spraying a first amount of coating material from the moving spray gun onto the workpiece as the workpiece is conveyed opposite the spray gun;

determining passage of an end portion of the workpiece past the spray gun, said end portion being at an end of said workpiece in the conveying direction; and spraying a reduced amount of coating material, as compared to said first amount, from the moving spray gun opposite the end portion of the workpiece as the end portion is conveyed past the spray gun in response to a determination of passage of the end portion past the spray gun.

2. The method of claim 1 wherein said detecting step comprises detecting a unit amount of movement of the conveyor and detecting the shape of the workpiece per unit amount of movement.

3. The method of claim 1 including the step of defining a half cut region at the end portion, wherein said spraying step comprises spraying a reduced amount of coating material at said half cut region.

* * * * *